United States Patent [19]

Sicher

[11] Patent Number: 4,647,735

[45] Date of Patent: Mar. 3, 1987

[54] ELECTRICAL SECURITY DEVICE

[75] Inventor: John D. Sicher, Roxbury, Conn.

[73] Assignee: Unimax Switch Corporation, Wallingford, Conn.

[21] Appl. No.: 730,338

[22] Filed: May 3, 1985

[51] Int. Cl.[4] ..... H01H 27/06

[52] U.S. Cl. ..... 200/43.08; 200/43.22; 200/50 A; 200/153 T; 339/119 C

[58] Field of Search ..... 200/43.22, 43.08, 43.02, 200/43.04, 333, 50 A, 50 B, 43.07, 43.06, 43.01, 61.62, 153 T; 220/345, 346, 242, 210; 70/158, 163–170; 339/37, 5 RL, 6 RL, 8 RL, 2 RL, 119 C, 147 C, 157 C

[56] References Cited

U.S. PATENT DOCUMENTS

| | | | |
|---|---|---|---|
| 1,212,632 | 1/1917 | Hammond | 200/43.08 |
| 1,795,321 | 3/1931 | Sunkenberg | 200/43.08 |
| 2,470,320 | 5/1949 | Page | 339/147 C |
| 2,659,782 | 11/1953 | Wolf | 200/61.62 |
| 3,013,105 | 12/1961 | Craig | 339/147 C |
| 3,321,589 | 5/1967 | Persia et al. | 200/43.08 |
| 3,524,029 | 8/1970 | Laff | 200/43.02 |
| 4,063,110 | 12/1977 | Glick | 200/43.08 |
| 4,479,688 | 10/1984 | Jennings | 339/37 |
| 4,580,019 | 4/1986 | Takahashi | 200/153 T |

*Primary Examiner*—Stephen Marcus
*Assistant Examiner*—Linda J. Sholl
*Attorney, Agent, or Firm*—Bernard Malina

[57] ABSTRACT

An electrical security apparatus includes an enclosure in which there is mounted an electrical receptacle which may be connected to a source of electrical power via its own power cord and plug. The enclosure is proportioned to receive the end of the power cord and the power plug of independently operated electrical device by plugging it into the electrical receptacle which makes direct connection to the power source provided in the apparatus through its power cord and plug. A keylock, operated by a removable key, is provided on the exterior of the enclosure. In the first position, the keylock, operated by a removable key, allows the top panel of the enclosure to be opened and closed. In the second position, the keylock locks the top panel and prevents removal of the power plug of the independently operated electrical device therefrom. In the third position, the keylock operates a switch to allow current to flow from the power source to the independently operated electrical device. The required use of the key to permit current flow to the electrical device prevents unauthorized use thereof.

12 Claims, 8 Drawing Figures

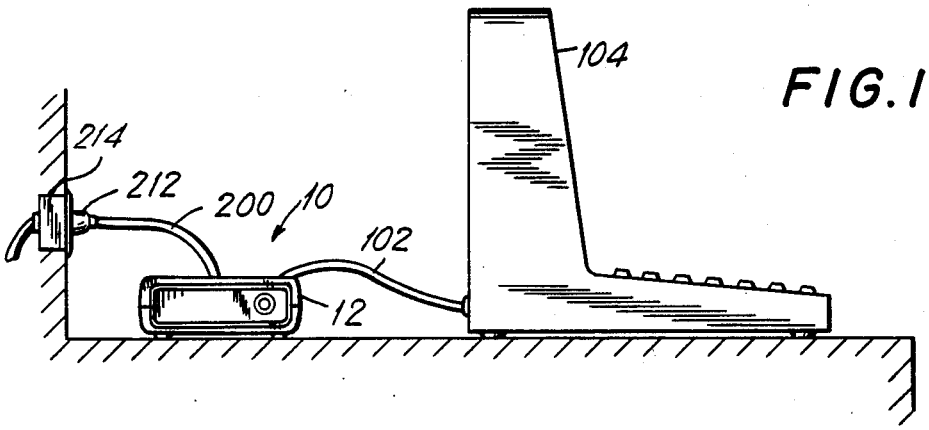
FIG. 1
FIG. 2
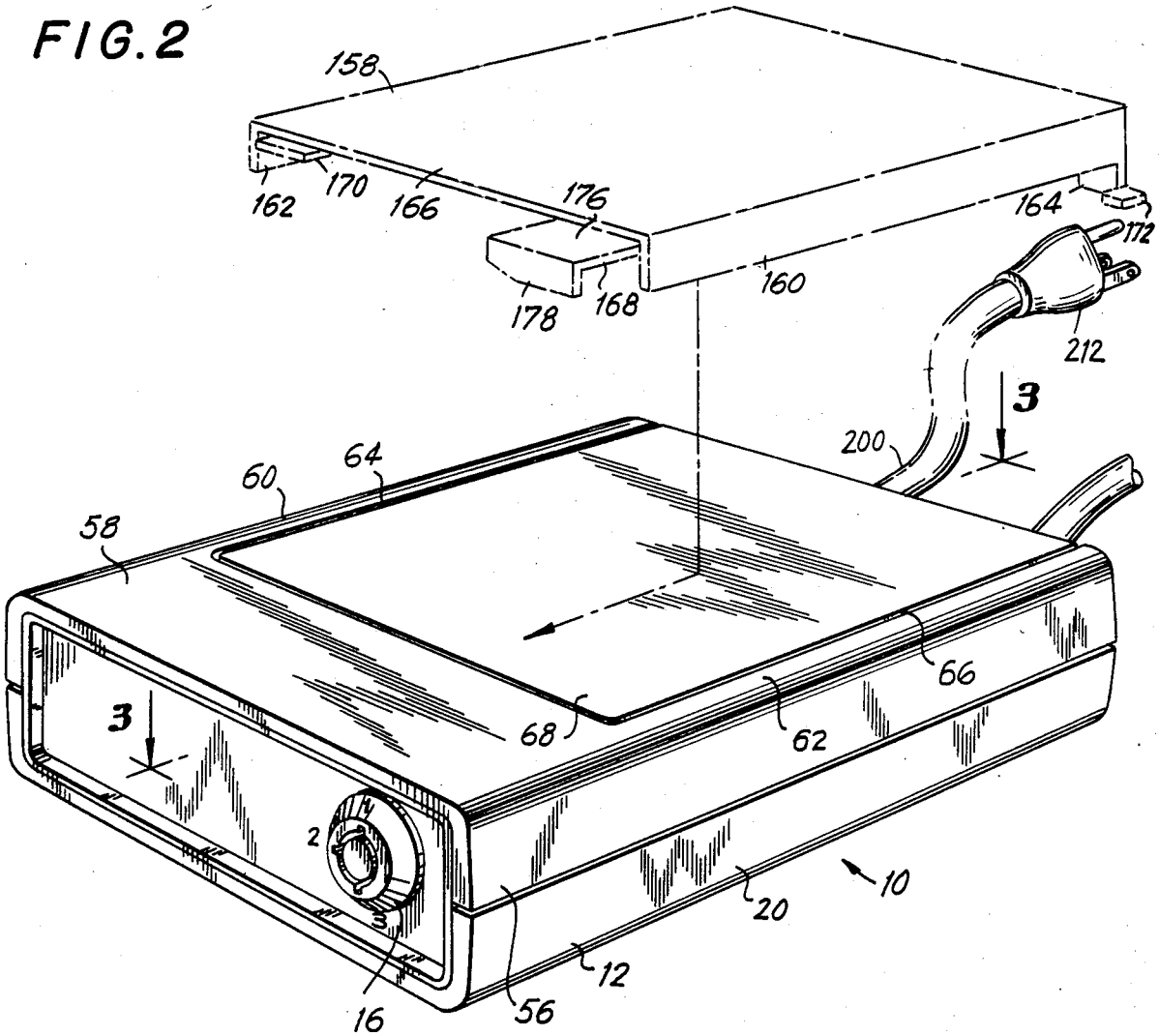

212
204
200
12
194
218
102
6
7
4
90
94
172
198
196
84
92
5
210
18
108
124
108
132
114
14
16
112
130
112

ELECTRICAL SECURITY DEVICE

BACKGROUND OF THE INVENTION

With the widespread and ever increasing use of all types of electrical equipment, there has developed a need for an apparatus which can control the unauthorized use of this equipment. The need for this type of apparatus has developed as a result of the increasing interest in and emphasis on security and safety, as related to the operation of electrical equipment.

In the field of power tools which are used in the home and in schools, there is a need to restrict the use of these devices to authorized users and prevent use thereof by small children in the home or students who have not received the appropriate training. There is a similar need to limit the use of certain electrical kitchen equipment such as grinders, food processors and slicers.

In the home, it is often necessary to control the use of television receivers and video tape recorders by children. This need is related to a desire to limit the extent of television viewing by children and to restrict this use to programming which is considered appropriate.

In commercial offices, there is often a need to restrict the use of office copiers, typewriters, and other electrical equipment and to prevent the use of this equipment by unauthorized persons. This requirement often occurs when an office must remain open for purposes of cleaning or maintenance after the end of the normal business day when the authorized personnel are no longer present.

Another reason for the development of a means of limiting the operation of equipment to authorized users has been the widespread application of computers to every phase of commercial and industrial activity. This has resulted in a situation where an unauthorized user can, either unintentionally or intentionally as a result of malice, do a substantial amount of damage. This damage can result from both the entry into computer networks and the destruction or tampering with the equipment or data, as well as the obtaining of sensitive information stored in these files.

In addition, in laboratories where certain electrically operated sensitive test equipment is located, there is a similar need to restrict access to such equipment.

Recently, selected types of electrical equipment include a keylock feature in which a removable key is used to activate a switch which applies electrical power to the equipment. This feature meets the need for a means for limiting the operation of the equipment to authorized users. However, this feature is found only in relatively expensive types of equipment. The incorporation of this feature on existing equipment is quite costly and in most cases extremely difficult or impossible. Thus, there is compelling need for a practical and economical means for controlling the use of electrical equipment.

OBJECTS OF THE INVENTION

It is an object of the present invention to provide an electrical security apparatus for limiting the operation of electrical equipment to authorized users.

Another object of the present invention is to provide an electrical security apparatus which may be operated by a removable key in order to connect an electrically operated device to a source of power.

Another object of the present invention is to provide an electrical security apparatus which can be easily installed on existing electrically operated devices without a need for modification of these devices in any way.

Still another object of the present invention is to provide an electrical security apparatus which comprises a relatively small number of component parts which are economical to manufacture, resulting in a relatively low unit cost.

SUMMARY OF THE INVENTION

In accordance with the present invention, there is provided an electrical security apparatus for preventing the unauthorized use of electrically operated devices, which comprises an enclosure which is proportioned to accept the plug of an independently operated electrical device. The enclosure includes a hinged, slideable or removable cover panel. With the cover panel removed, the plug of the independently operated electrical device to be controlled is connected to an electrical receptacle located in the enclosure. The end of the power cord and the plug of the independently operated electrical device enter through a slot in a wall of the enclosure; the enclosure may be designed to prevent reverse passage of the plug therethrough. The receptacle is electrically connected to the security apparatus power cord and plug which make the direct connection to the power source.

A keylock, operated by a removable key, is provided on a front panel of the housing. The keylock is disposed both to lock the cover panel of the enclosure and to operate an electrical power switch inside the enclosure. In a first position, the key-operable keylock allows the cover panel to be opened and closed; when the key is in the second position, the keylock locks and secures the top cover panel in place and prevents removal of the power plug of the independently operated electrical device from the enclosure. With the key in the third position, the keylock operates a switch, thereby allowing current to flow from the power source through the security device to the independently operated electrical device. The plug which is part of the independently operated electrical device can only be removed from the security device if the keylock is returned to the first position and the cover panel is removed. The required use of the key to allow current to flow prevents unauthorized use of the independently operated device.

BRIEF DESCRIPTION OF THE DRAWINGS

Additional objects and advantages of the invention will become apparent in the course of the following specification when taken in connection with the accompanying drawings in which:

FIG. 1 is a side elevation view of an electrical security apparatus made in accordance with the present invention with the apparatus shown in use connected to a computer terminal and to a wall receptacle;

FIG. 2 is a perspective view of the electrical security apparatus of FIG. 1 with the cover of the apparatus shown removed from the apparatus and in broken lines;

DETAILED DESCRIPTION OF THE INVENTION

Figure 3:
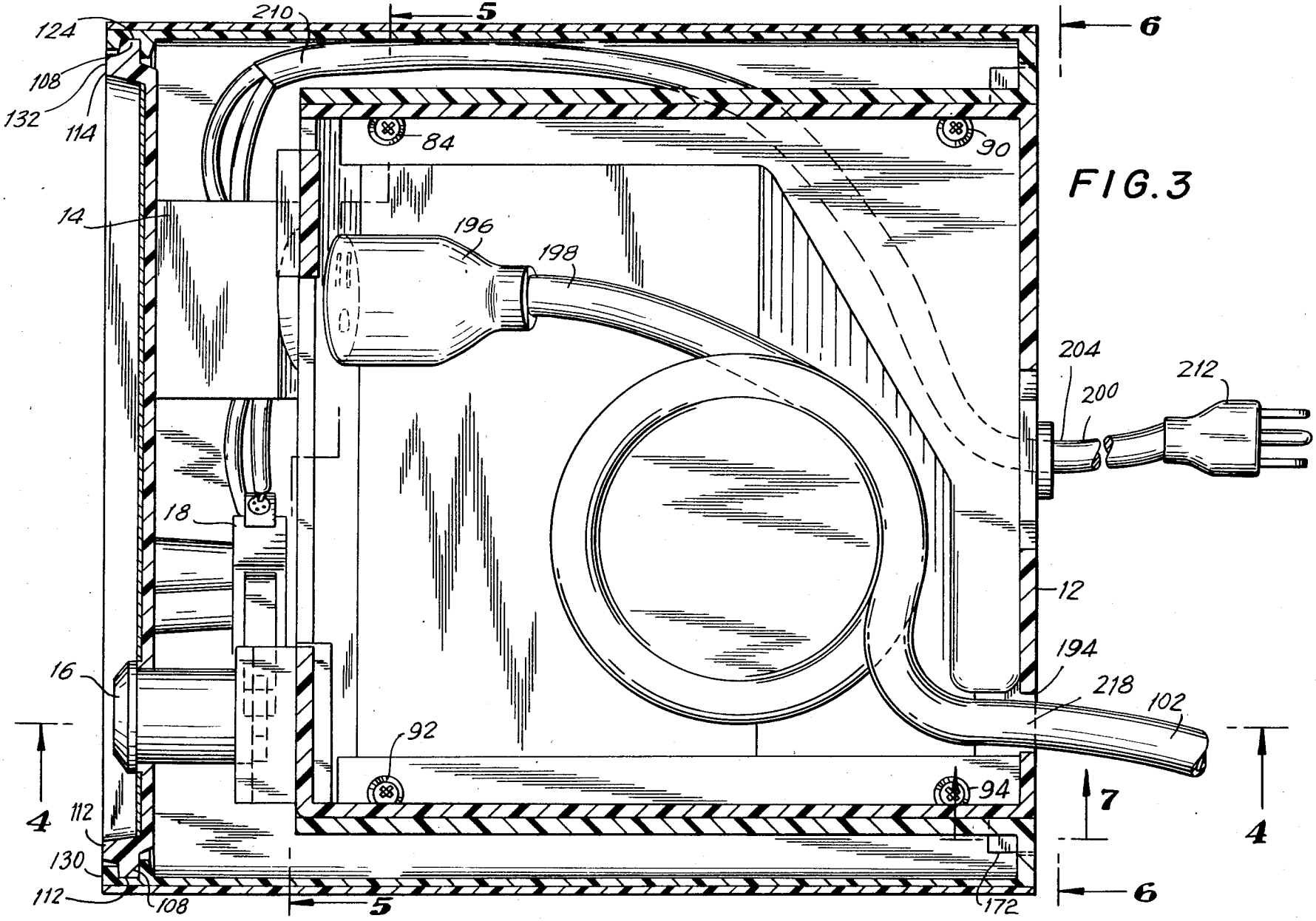
FIG. 3 is a cross-sectional view taken along the line 3—3 of FIG. 2.

With reference to the drawings, there is shown in FIGS. 1-5 an electrical security apparatus 10, in accordance with the present invention, comprising a housing or enclosure 12 in which an electrical receptacle 14, a keylock 16, and an electrical switch 18 are mounted.

The enclosure 12 comprises a lower portion 20 which includes a bottom panel 22 on the ends 24, 26 of which there are integrally formed side walls 28, 30. The upper edges 32, 34 of the side walls 28, 30 includes a step portion 36, 38. The step portions 36, 38 each accept a lip 40, 42 which is formed on the lower edge 44, 46 of a pair of upper side walls 48, 50 which are integrally formed on the end portions 52, 54 of an upper portion 56 of the enclosure 12. The upper portion 56 of the enclosure includes a top wall 58 portions 60, 62 of which extend along the sides 64, 66 of a removable cover 68 which will be described presently.

Figure 5:
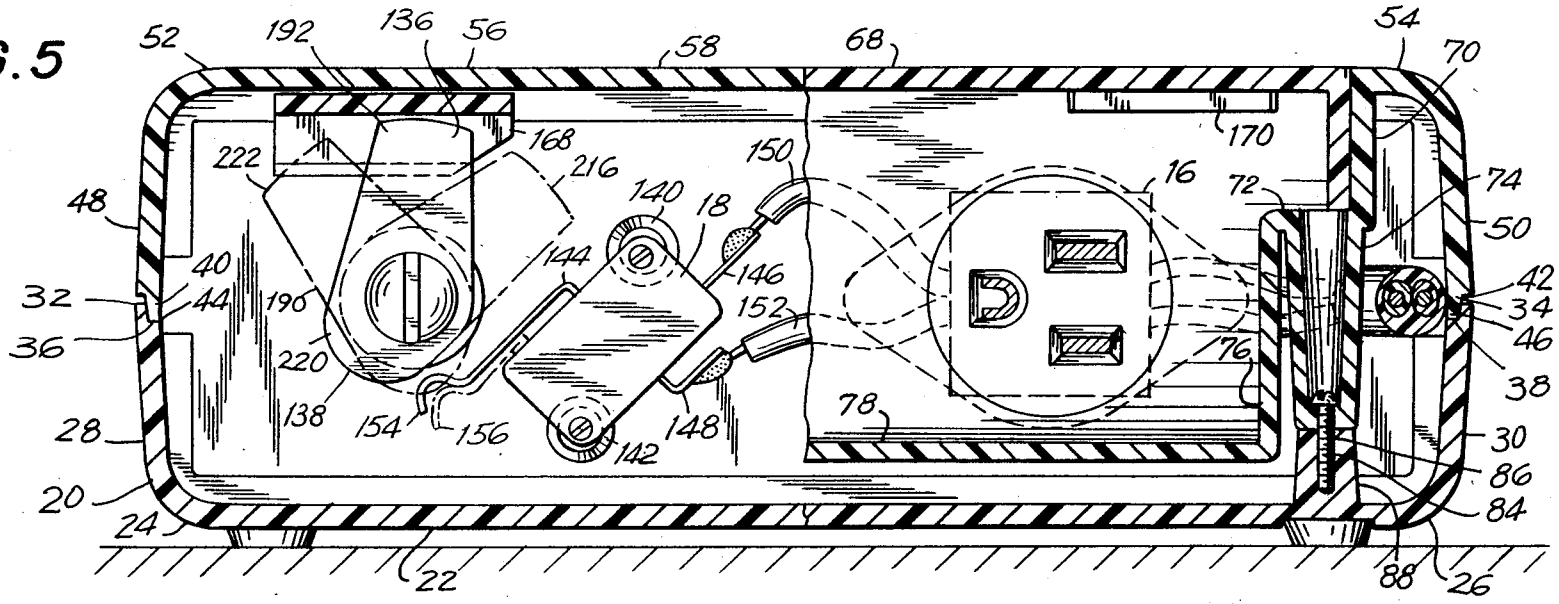
FIG. 5—5 is a cross-sectional view taken along the line 5—5 of FIG. 3.

As is best shown in FIG. 5, the upper portion 56 of the enclosure 12 includes an inner wall portion 70 which projects downward into the enclosure. The inner wall portion 70 includes a step portion 72 which has a downwardly projecting hollow boss 74. The lower end 76 of the inner wall portion 70 is connected to an integrally formed lower panel 78. The lower panel 78 includes a horizontal portion 80 and an inclined portion 82. The upper portion 56 of the enclosure 12 is connected to the lower portion 20 of the enclosure by means of a screw 84 which engages a threaded hole 86 in a boss 88 which is integrally formed on the bottom panel 22. As is shown in FIG. 3, the screw 84 is one of four screws 84, 90, 92, 94 which fasten the upper and lower portions 20, 56 of the enclosure in the manner which has just been described.

Figure 4:
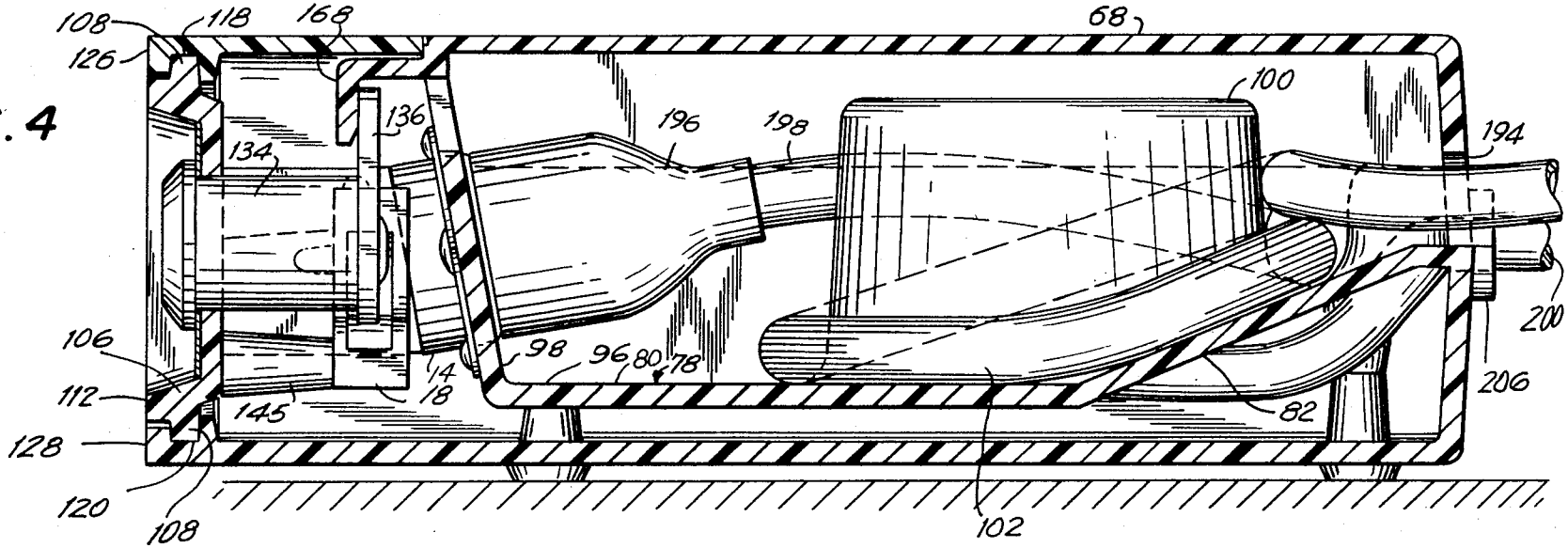
FIG. 4—4 is a cross-sectional view taken along the line 4—4 of FIG. 3.

The front portion 96 of the lower panel 78 is connected to an integrally formed inclined panel 98. The electrical receptacle 14 is mounted on the inclined panel 98 as is best shown in FIG. 4. The lower panel 78 also includes an integrally formed generally cylindrical core 100 which is used to coil an electrical power cable 102 of an appliance or other electrically operated device which is used with the electrical security apparatus 10 according to the present invention. An example of such a device is the computer terminal 104 shown in FIG. 1. The cylindrical core 100 facilitates the coiling and storage of excess cable lengths within the electrical security apparatus 10, as is shown in FIGS. 3 and 4.

The enclosure 12 includes a front panel 106 which includes a lip portion 108 formed on top 110, bottom 112 and side 114, 116 edges. The lip portion 108 is retained in corresponding grooves 118, 120, 122, 124 which are formed in the upper 126, lower 128 and side portions 130, 132 of the enclosure 12. The keylock 16 is mounted on the front panel 106 and includes a cylinder portion 134 which projects into the enclosure and a lock operator 136 which has a cam portion 138, the operation of which will be presently described. As is best shown in FIGS. 4 and 5, the front panel 106 also includes a pair of bosses 140, 142 on which the electrical switch 18 is mounted. The switch 18 includes an operating lever 144 and a pair of terminals 146, 148. The terminals 146, 148 are connected to the electrical receptacle 16 by means of leads 150, 152. The operating lever 144 is capable of a first position 154, shown in solid lines, in FIG. 5 in which the switch 18 is off and a second position 156, shown in broken lines, in which the switch 18 is on. When the switch 18 is in the off position, electrical current is prevented from flowing into the receptacle 14.

Figure 6:
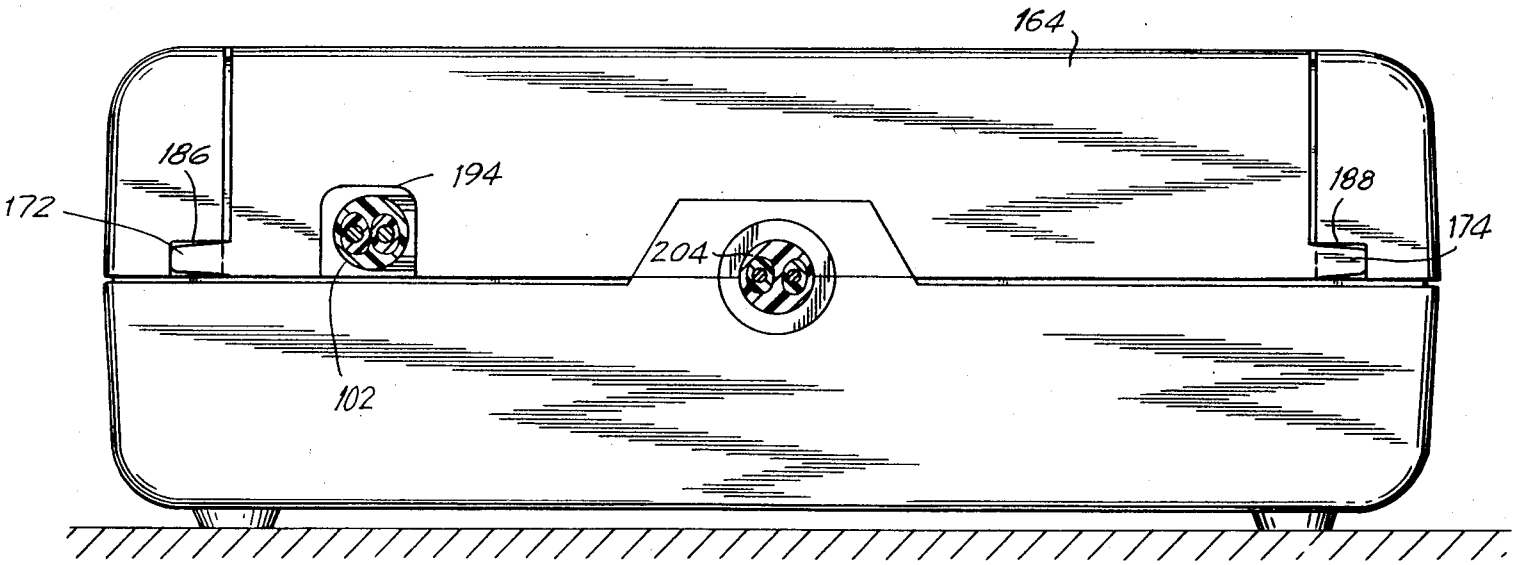
FIG. 6 is an end view taken along the line 6—6 of FIG. 3.
Figure 8:
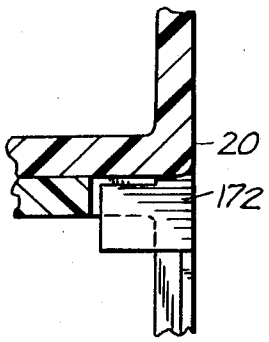
FIG. 8 is a fragmentary cross-sectional view taken along the line 8—8 of FIG. 7.
Figure 7:
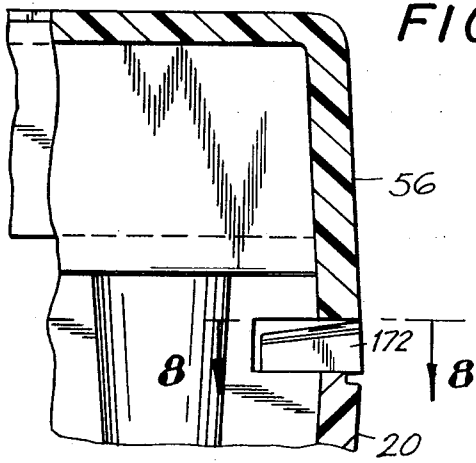
FIG. 7 is a fragmentary cross-sectional view taken along the line 7—7 of FIG. 3.

In FIG. 2, the cover 68 has been shown removed from the apparatus 10 and has been drawn in broken lines. The cover 68 includes a top panel 158, a pair of side panels 160, 162 and a back panel 164. The front portion 166 of the top panel 158 includes two front lock tabs 168, 170 as shown in FIGS. 2, 4 and 5 and a pair of rear lock tabs 172, 174 which are best shown in FIGS. 2, 6, 7 and 8. The front lock tab 168 includes a horizontal portion 176 which projects under the top wall 58 of the upper portion 56 of the enclosure 12 and a vertical portion 178 which engages the lock operator 136, as will be presently described. The rear lock tabs 172, 174 are located on the bottom edge 180 of the back panel 164 and comprise horizontal members 182, 184 which project outwardly. The rear lock tabs 172, 174 engage notches 186, 188 which are formed in the upper portion 56 of the enclosure 12, as is shown in FIGS. 6, 7 and 8. When the lock operator 136 is in the locked position shown in solid lines 220 and also in the position shown in broken lines 190 in FIG. 5, the end 192 of the lock operator 136 engages the front lock tab 168 and the front and rear lock tabs 168, 172, 174 prevent removal of the cover 68.

The back panel 164 of the cover 68 includes a notch 194 which is large enough to admit the electrical power cable 102, yet small enough to prevent passage of the power plug 196 which is mounted on the end 198 of the power cable 102.

The apparatus 10 includes a three wire power cord 200 one end 202 of which is connected electrically to the electrical receptacle 14. An intermediate portion 204 of the power cord 200 passes through a tightly fitted strain relief grommet 206 which is mounted in the rear wall 208 of the lower portion 20 of the enclosure 12. The end 210 of the power cord 200 is connected to a power plug 212 which is used to connect the apparatus 10 to a source of electrical power such as the wall receptacle 214, as is shown in FIG. 1.

In use, a key which is not shown and which fits the key-lock 16 in a conventional manner is used to turn the lock operator 136 to the unlocked position indicated by the broken lines 216 in FIG. 5 and the cover 68 is removed. For purposes of reference, this unlocked position is designated as the first position. The power plug 196 of an apparatus, such as the computer terminal 104 of FIG. 1, is inserted into the electrical receptacle 14 as is shown in FIGS. 3 and 4 and an intermediate portion 218 of the power cord 102 is inserted in the notch 194. The cover 68 is replaced and the lock operator 136 is turned to the second, i.e. locked position shown in solid lines 200 in FIG. 5. The power cord 102 cannot be removed from the apparatus 10, thus preventing unauthorized use.

To operate the appliance 104, the key is turned to a third position in which the operator is in the position shown in broken lines 190 in FIG. 5. In this position, the end 222 of the lock operator 136 still engages the lock tab 168, preventing removal of the cover 68, and the cam portion 136 has rotated to bear on the switch lever 144 depressing the switch lever 144 to the position shown in broken lines 156, thereby turning the switch on and thus connecting the appliance 104 to the source of electrical power.

When operation of the appliance 104 has been completed, the key is used to turn the lock operator 136 to the second position shown in solid lines 220 in FIG. 1. In this position, the cam portion 138 of the lock operator 136 has rotated away from the switch lever 144, thereby disconnecting the appliance 104 from electrical power. In this position, the cover 68 remains locked on the enclosure 12 preventing unauthorized removal of the power cord 102 from the apparatus.

In the locked position, the rear lock tabs 172, 174 engage the enclosure 12 and in combination with the front lock tabs 168, 170 and lock operator 136 securely lock the cover 68 to the enclosure 12 to restrict the opening of the enclosure to persons who are authorized to unlock the keylock 16. When the keylock 16 is unlocked, the cover 68 may be slid to the rear in a direction away from the keylock 16, thus removing the tabs from engagement with the enclosure 12 and enabling removal of the cover 68.

In the event that it is desired to remove the electrical security apparatus 10, the key is turned to the first position to unlock the cover 68 and the plug 196 is removed from the receptacle 14.

While a preferred embodiment of the invention has been shown and described herein, it is obvious that numerous additions, changes and omissions may be made in such embodiments without departing from the spirit and scope of the invention.

What is claimed is:

1. An electrical security apparatus for an electrically operated device having a power cord and a power connector for connecting said power cord to a source of electrical power comprising, housing means having a plurality of wall portions, removable enclosing means mounted on said housing means, electrical receptacle means mounted in said housing means capable of receiving said power connector, power cable means connected to said electrical receptacle for connecting said electrical receptacle to a source of electrical power, electrical switch means mounted in said housing, and capable of energizing and deenergizing said electrical receptacle means, electrical connection means connecting said switch means and said electrical receptacle means, locking means mounted on said housing and capable of a first unlocked position in which said enclosing means may be removed from said housing, a second position engaging said removable enclosing means to lock said removable enclosing means onto said housing means, and a third position also engaging said removable enclosing means, to lock said removable enclosing means onto said housing means and actuating said electrical switch means to energize said electrical receptacle means, said locking means comprising lock operating means, and said lock operating means comprising an elongated member having a first end capable of engaging said removable enclosing means and a second end capable of bearing on said switch means for the purpose of operating said switch means, and retaining means for retaining said power connector of said electrically operated device within said housing, thereby limiting the operation of said device to persons capable of operating said locking means.

2. An electrical security apparatus according to claim 1, in which said locking means comprises a key lock.

3. An electrical security apparatus according to claim 1, in which said second end of said lock operating means comprises a cam portion.

4. An electrical security apparatus according to claim 1, in which said switch means includes switch lever means capable of operating said switch means when said switch lever means is actuated by said second end of said lock operating means.

5. An electrical security apparatus according to claim 1, in which said retaining means comprises a notch portion formed on a wall portion of said housing means with said notch portion proportioned of a size to accept said power cord and permit passage of said power cord through said wall of said housing means, and proportioned to prevent passage of said power connector through said wall of said housing means, and with said removable enclosing means overlying said notch portion, preventing removal of said power connector, thereby retaining said power connector within said housing means.

6. An electrical security apparatus according to claim 1, further comprising cylindrical core means disposed within said housing means for coiling intermediate portions of said power cord.

7. An electrical security apparatus according to claim 1, in which said removable enclosing means includes at least one projecting portion and in which said housing means includes at least one recessed portion with said projecting portion retained by said recessed portion when said removable enclosing means is mounted on said housing means.

8. An electrical security apparatus according to claim 1, in which said plurality of wall portions is disposed in the configuration of an open box.

9. An electrical security apparatus according to claim 1, in which said removable enclosing means includes a plurality of projecting portions and in which said housing means includes a plurality of recessed portions with said projecting portions retained by said recessed portion when said removable enclosing means is mounted on said housing means.

10. An electrical security apparatus according to claim 8, in which said plurality of wall portions is disposed in the configuration of a partially covered box.

11. An electrical security apparatus according to claim 9, in which said locking means engages one of said plurality of projecting portions when said locking means is in said second position and in said third position.

12. An electrical security apparatus according to claim 1, in which said removable enclosing means comprises a cover panel capable of a first position to expose the interior of said housing means and second position closing said housing means.

* * * * *